US006073875A

United States Patent [19]

Paugh

[11] Patent Number: 6,073,875

[45] Date of Patent: Jun. 13, 2000

[54] RETRACTION REEL FOR KEYS AND THE LIKE

[76] Inventor: Edward C. Paugh, 80 Huntington St., No. 608, Huntington Beach, Calif. 92648

[ * ] Notice: This patent is subject to a terminal disclaimer.

[21] Appl. No.: 09/140,788

[22] Filed: Aug. 27, 1998

Related U.S. Application Data

[63] Continuation of application No. 08/957,248, Oct. 24, 1997, Pat. No. 5,833,165.

[51] Int. Cl.[7] ..... B65H 75/48

[52] U.S. Cl. ..... 242/379.2; 242/380

[58] Field of Search ..... 242/379, 379.2, 242/380, 402, 404.3; 33/413, 414, 755, 756, 769; 70/456 R; 119/796

[56] References Cited

U.S. PATENT DOCUMENTS

| | | | |
|---|---|---|---|
| 754,827 | 3/1904 | Thompson . | |
| 1,043,092 | 11/1912 | Goodwin | 242/380 |
| 1,262,005 | 4/1918 | Bell | 242/379.2 |
| 1,465,281 | 8/1923 | Morrison | 242/379.2 |
| 1,574,552 | 2/1926 | Chapman | 242/379.2 |
| 1,654,424 | 12/1927 | Mahaffey | 242/379 |
| 1,802,402 | 4/1931 | Best | 242/380 |
| 2,632,609 | 3/1953 | Kirby | 242/379 |
| 2,878,981 | 3/1959 | Guido | 242/379.2 |
| 2,920,393 | 1/1960 | Schoenfeldt | 242/380 |
| 2,959,414 | 11/1960 | Saltz | 242/379.2 |
| 3,547,371 | 12/1970 | Gruseck | 242/379.2 |
| 3,968,670 | 7/1976 | Quenot | 242/379 |
| 4,126,024 | 11/1978 | Timmons et al. | 242/379.2 |
| 4,192,078 | 3/1980 | Lore et al. | 33/414 |
| 4,197,656 | 4/1980 | Lane et al. | 33/414 |
| 4,565,011 | 1/1986 | Karger | 33/414 |
| 4,765,557 | 8/1988 | Kahmann . | |
| 4,813,145 | 3/1989 | Josey, Jr. et al. | 33/414 |
| 4,856,070 | 8/1989 | Britton et al. | 242/379.2 |
| 4,888,970 | 12/1989 | Kinzler et al. . | |
| 4,907,348 | 3/1990 | Hubbard, Jr. | 33/767 |
| 5,042,159 | 8/1991 | Millen | 33/414 |
| 5,251,464 | 10/1993 | Halter | 242/379.2 |
| 5,490,805 | 2/1996 | Bredesen | 242/379.2 |
| 5,509,616 | 4/1996 | Millen, Jr. et al. | 242/381.5 |
| 5,732,898 | 3/1998 | Odessky et al. | 242/379.2 |

FOREIGN PATENT DOCUMENTS

| | | |
|---|---|---|
| 2 535 956 | 5/1984 | France . |
| WO 97 42852 | 11/1997 | WIPO . |

OTHER PUBLICATIONS

International Search Report dated Jul. 13, 1998.

*Primary Examiner*—John M. Jillions
*Attorney, Agent, or Firm*—Pretty, Schroeder & Poplawski, P.C.

[57] ABSTRACT

A retraction unit for keys and the like having a housing with a reel mounted in the housing for rotation, a retraction spring for the reel, and a cable carried on the reel, with the inner end of the cable connected to the reel, and a cable end fitting carried on the outer end of the cable. The fitting has an axial passage with an inner end of a size for receiving the cable and a larger outer end of a size for receiving a cable terminal for retaining the fitting on the cable, the fitting having an inner end, a central portion and an outer end, with the central portion of a lesser cross section than the inner and outer ends, and wherein the housing has an outlet opening of a first lesser width and a second greater width, with the first lesser width of a size to accept the central portion of the fitting while not accepting the inner and outer ends thereof, and with the second greater width of a size to accept the inner end of the fitting, whereby the inner end of the fitting may pass through the greater width of the outlet opening positioning the central portion of the fitting in the lesser width of the outlet opening, with the outer end of the fitting engaging the housing and limiting movement of the fitting into the housing.

10 Claims, 3 Drawing Sheets

15
15
14
36
15A
16
40
5
5
17
39
38
38
31
37
25
22
15
32
19
33
18
20
21

17
13
36
16
14

40
36
17
31
18

RETRACTION REEL FOR KEYS AND THE LIKE

CROSS-REFERENCE TO RELATED APPLICATIONS

The present application is a continuation of U.S. patent application Ser. No. 08/957,248, filed Oct. 24, 1997, now U.S. Pat. No. 5,833,165.

BACKGROUND OF THE INVENTION

This invention relates to retraction units which are widely used today for retaining and retracting keys, tags, access cards and the like, and which often are referred to as key reels. Conventional key reels have a reel and spring carried in a housing, with a chain or cable on the reel. A fitting is carried on the outer end of the chain or cable for attaching a key or a key ring or a card or other object as desired. In use, the party pulls on the key, unreeling the cable from the reel. When the operation is finished, the party releases the key and the spring automatically winds the cable on the reel into the housing.

In the conventional design, the cable feeds from the reel and out of the housing with a substantially 90° bend. This repeated bending under tension significantly reduces the life of the cable. Problems have been encountered in the field with breakage of the chain and particularly with the stainless steel cables.

It is an object of the present invention to provide a new and improved retraction unit which will substantially eliminate the 90° bending of the cable during unreeling and reeling. In particular, it is an object of the invention to provide such a construction which will maintain the cable tangent to the reel during both unwinding and winding to reduce the wear and tear on the cable.

It is another object of the invention to provide a rest position for the cable which reduces the stress on the cable when in the nonuse condition.

Another problem with wear on the cable arises from the fact that the retraction unit often is used in atmospheres with dust, moisture, and other materials which are detrimental to the life of the cable. Accordingly, it is another object of the invention to provide a new and improved construction incorporating a dust shield movable within the housing and providing protection when the cable is in the rest position and when the cable is in the unreeling and reeling position. Other objects, features, advantages and results will more fully appear in the course of the following description.

SUMMARY OF THE INVENTION

Briefly the subject invention relates to a retractable reel for a key chain having a configuration which maintains the cable tangential to the reel during both winding and unwinding in order to reduce wear and tear on the cable. The invention also includes a rest receptacle for receiving the ball of the cable fitting for securing the cable in place while not in use.

Preferably, a dust shield is positioned around the cable and reel, within the housing. The dust shield is tubular with a peripheral opening for passage of the cable during reeling and unreeling. Also, a peripheral rib may be provided on the exterior of the shield for sliding engagement with a slot in the housing.

In use, the fitting is moved out of the rest receptacle for passing outward through a larger portion of an opening and with this arrangement, the cable is tangential to the reel during both the unwinding and winding. After the cable is wound onto the reel, the user moves the cable fitting into a smaller portion of the outlet opening which relieves the stress on the cable.

DESCRIPTION OF THE PREFERRED EMBODIMENTS

Figure 1:
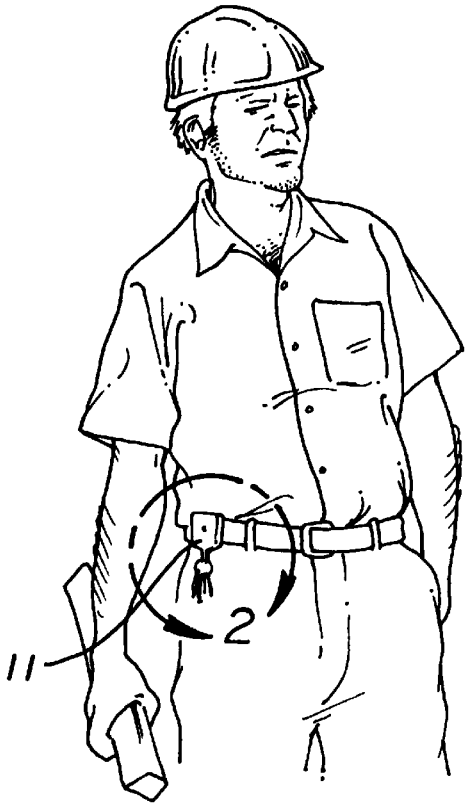
FIG. 1 is a view of a workman with a retraction unit for keys carried on his belt.
Figure 2:
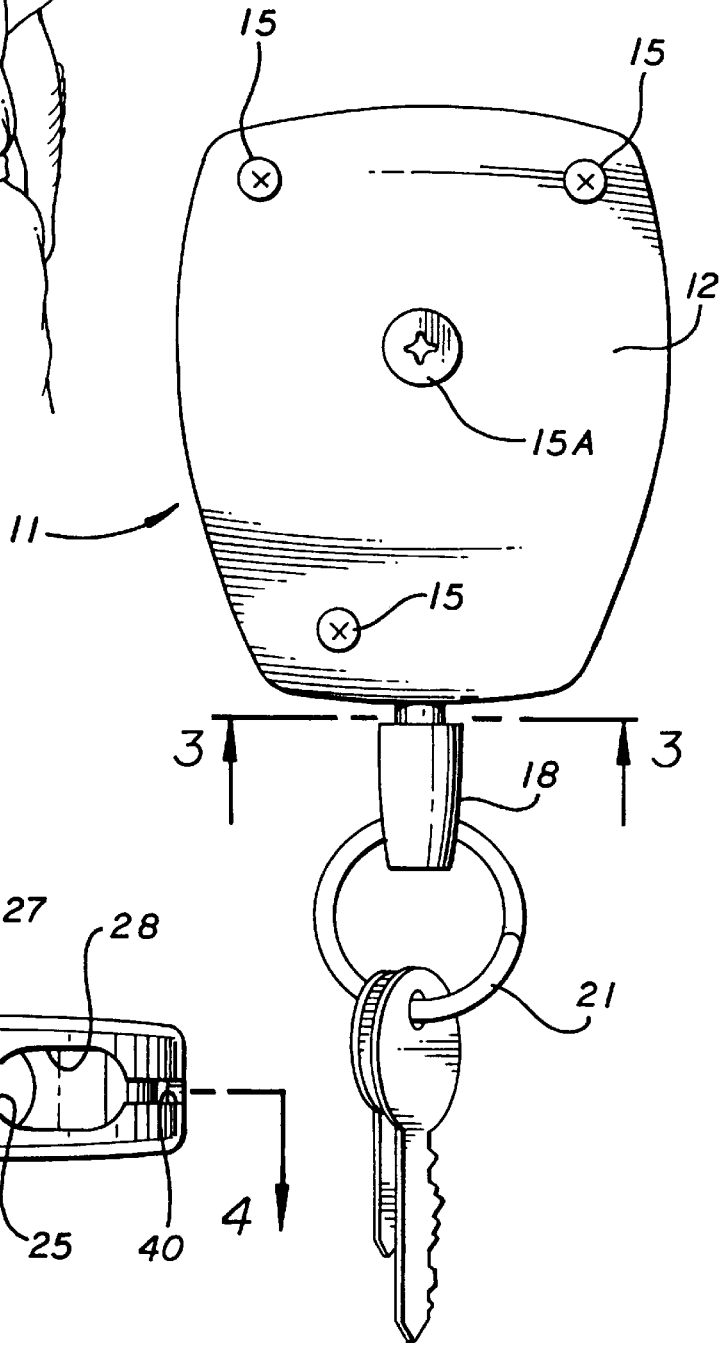
FIG. 2 is an enlarged view of the unit in the circle 2 of FIG. 1.

A retraction unit for a key reel 11 is shown in FIG. 1 carried on a belt of a workman. The retraction unit includes a housing 12 formed of housing halves 13,14 joined by screws 15. A screw 15A may be provided to attach a conventional belt clip (not shown). A reel 16 is mounted in the housing with a spring (not shown) in the conventional manner. A cable 17 is wound on the reel, with the inner end of the cable connected to the reel and with a cable fitting 18 on the outer end of the cable. A cable terminal, typically a ball 19, is affixed to the outer end of the cable, with the cable passing through a central passage 22 of the fitting. The outer end of the fitting passage is large enough to receive the ball 19, while the central portion of the passage will not pass the ball, thereby retaining the fitting on the cable. Typically a transverse opening 20 is provided adjacent the outer end of the fitting, for receiving a ring 21, or other retaining device. The construction described thus far is conventional and widely used in the industry.

Figure 4:
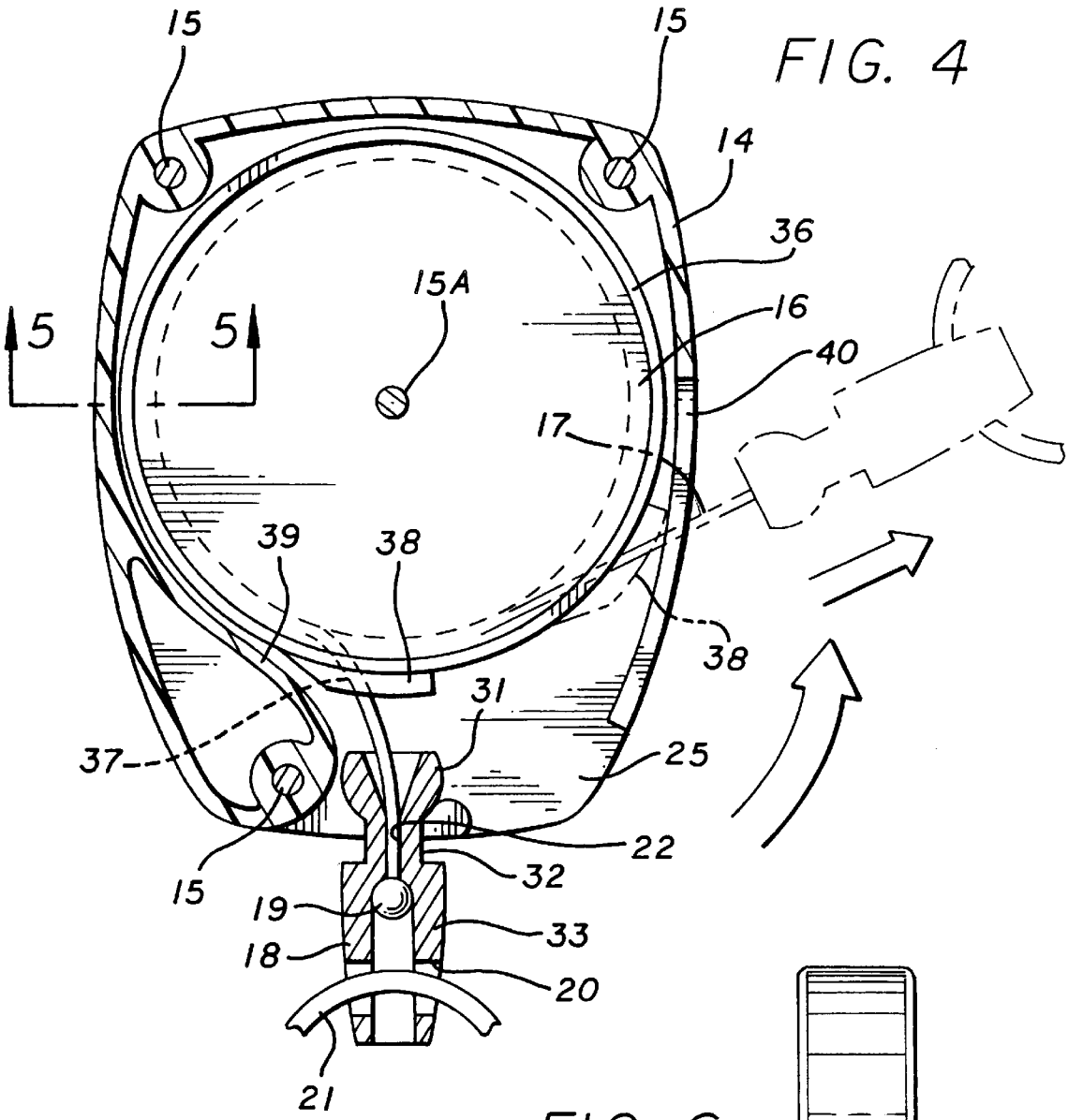
FIG. 4 is an enlarged sectional view taken along the line 4—4 of FIG. 3.
Figure 5:
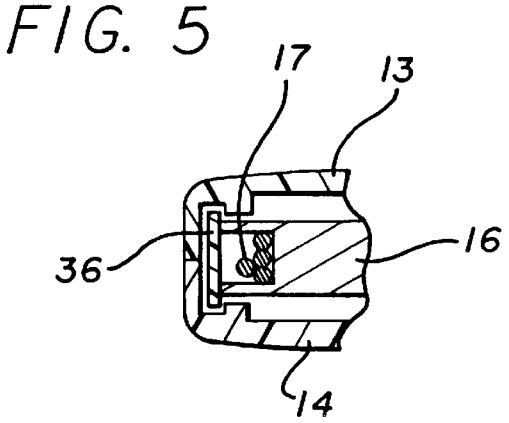
FIG. 5 is a partial sectional view taken along the line 5—5 of FIG. 4.
Figure 6:
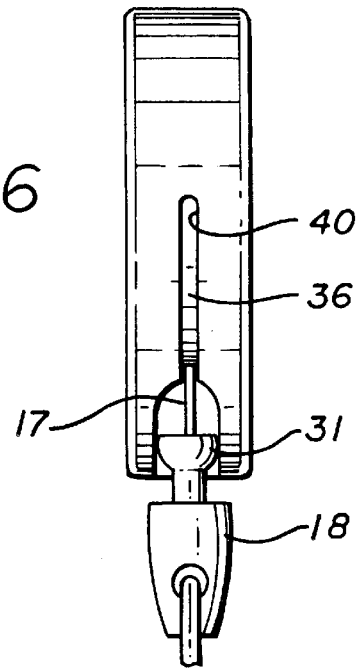
FIG. 6 is a reduced right side view of the unit of FIG. 2.
Figure 7:
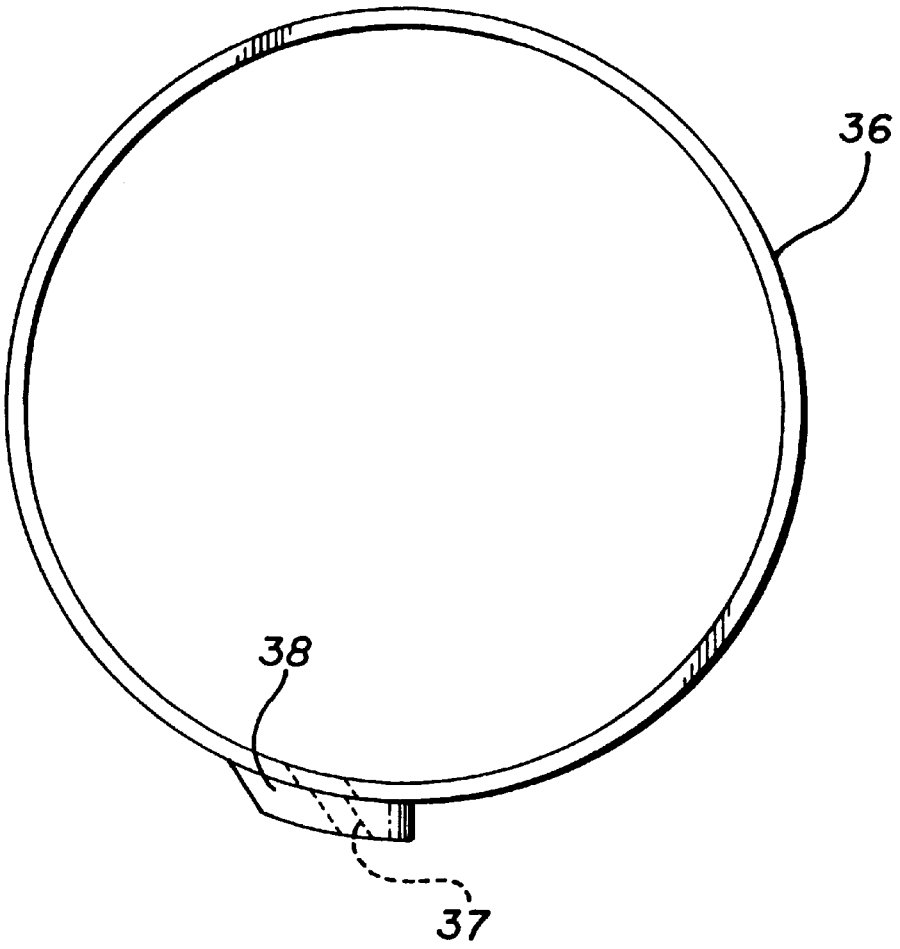
FIG. 7 is a side view of a dust shield.
Figure 8:
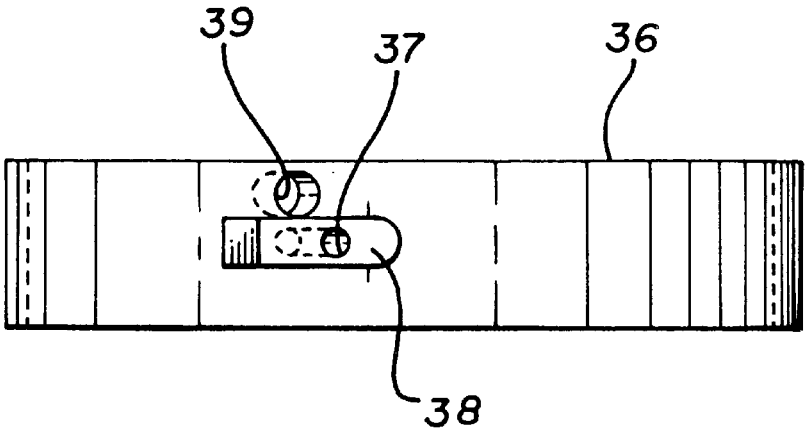
FIG. 8 is an end view of the dust shield of FIG. 7.

An outlet opening 25 is provided in the lower end 26 of the housing. The outlet opening has a first section 27 of lesser width and second section 28 of greater width. The fitting 18 has an inner end 31, a central portion 32, and an outer end 33. The central portion 32 is of a lesser cross section than the inner and outer ends. Typically the fitting is cylindrical in configuration, with the inner end 31 of a spherical shape and the first section 27 of the outlet opening 25 has a concave shape for receiving the spherical end, as best seen in FIG. 4. Preferably the inner end of the passage through the fitting is conical, as best seen in FIG. 4, to eliminate any sharp bends in the cable as it passes out of the fitting.

Figure 3:
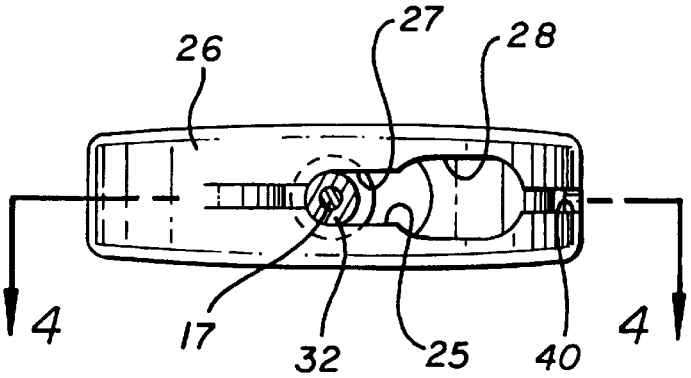
FIG. 3 is a sectional view taken along the line 3—3 of FIG. 2.

Preferably the first section 27 of the outlet opening is directed along a radius of the reel, and the second section 28 is directed tangential to the reel, as seen in FIGS. 3 and 4.

With this construction, the inner end 31 of the fitting may pass through the greater width portion 28 of the outlet opening to position the central portion 32 of the fitting in the lesser width section of the outlet opening, as shown in solid lines in FIG. 4. When in this condition, engagement of the outer end 33 of the fitting with the housing prevents the outer end of the cable from entering the housing. Also, engagement of the inner end 31 of the fitting in the inner end of the first section 27 of the outlet opening prevents the cable from being unreeled. There is a secure rest position for the cable when there is no desire utilize the object being carried on the end of the cable.

When it is desired to unreel the cable, the user moves the fitting radially inward to lift the fitting out of the first section of lesser width, permitting the fitting to swing into the second section of greater width 28. Then the fitting is pulled out through the section 28, unreeling the desired amount of cable. In this operation, the cable will be unreeled with the cable substantially tangential to the reel thereby significantly reducing bending stress in the cable. When the user is through with the key or other object, the user may release the object, and the retraction unit will reel in the cable automatically. When the fitting enters the outlet opening portion 28, contact of the fitting with the housing will stop reeling. Then the user can move the fitting into the position shown in solid lines in FIG. 4, completing the use or operation.

A dust shield 36 is positioned in the housing around the cable and reel. Preferably the dust shield is tubular with a peripheral opening 37 providing for passage of the cable as the cable is unreeled off of and reeled onto the reel 16.

Preferably a peripheral rib 38 is provided on the exterior surface of the dust shield with the peripheral opening 37 in the dust shield and substantially tangential to the reel. The rib of the dust shield is shown in the rest position in solid lines, and in the operating position in dashed lines. The dust shield freely rotates on the reel, with the motion limited by engagement of the rib with portions of the housing. An opening 39 is provided in the dust shield for initial insertion of the inner end of the cable to the reel. A clearance slot 40 is provided in the housing for the cable 17, permitting movement of the cable fitting 18 between the solid line and phantom line positions of FIG. 4.

I claim:

1. In a retraction unit for keys and the like, said unit having a housing with a reel mounted in said housing for rotation, a retraction spring for said reel, and a cable carried on said reel, with the inner end of said cable connected to said reel, and a cable end fitting carried on the outer end of said cable, the improvement:

said fitting having an inner end, a central portion and an outer end, with said central portion of a lesser cross section than said inner and outer ends, and wherein said housing has means defining an outlet opening of a first lesser width and a second greater width, with said first lesser width of a size to accept said central portion of said fitting while not accepting said inner and outer ends thereof, and with said second greater width of a size to accept said inner end of said fitting, whereby said inner end of said fitting may pass through said greater width of said outlet opening positioning said central portion of said fitting in said lesser width of said outlet opening, with said outer end of said fitting engaging said housing and limiting movement of said fitting into said housing.

2. A unit as defined in claim 1 wherein said inner end of said fitting is spherical and said first lesser width of said outlet opening has a concave shape for receiving said fitting inner end.

3. A unit as defined in claim 2 wherein said first lesser width of said outlet opening is along a radius of said reel and said second greater width of said outlet opening is along a tangent of said reel.

4. A unit as defined in claim 1 wherein said first lesser width of said outlet opening is along a radius of said reel and said second greater width of said outlet opening is along a tangent of said reel.

5. A unit as defined in claim 1 including a dust shield positioned around said cable and reel, said dust shield being tubular with a peripheral opening for passage of said cable as said cable is unreeled off and reeled on said reel.

6. A unit as defined in claim 5 including a peripheral rib on the exterior of said dust shield with said peripheral opening in said peripheral rib and substantially tangent to said reel.

7. A unit a s defined in claim 6 including a clearance slot in said housing for said cable as said dust shield rotates on said reel.

8. The unit as defined in claim 1, wherein said outlet opening extends peripherally around the housing to permit movement of the cable fitting between a first position directly below the reel with the cable tangentially oriented to the reel and a second position above the reel with the cable tangentially oriented to the reel.

9. In a retraction unit for keys and the like, said unit having a housing with a reel mounted in said housing for rotation, a retraction spring for said reel, and a cable carried on said reel, with the inner end of said cable connected to said reel, and a cable end fitting carried on the outer end of said cable, the improvement:

wherein said housing has means defining an outlet opening of a size to accept said cable therethrough while not accepting an outer end of said fitting whereby said outer end of said fitting engages said housing and limits movement of said fitting into said housing;

wherein said outlet opening extends peripherally around the housing to permit movement of the cable fitting between a first position directly below the reel with the cable tangentially oriented to the reel and a second position above the reel with the cable tangentially oriented to the reel; and a dust shield positioned around said cable and reel, said dust shield being tubular with a peripheral opening for passage of said cable as said cable is unreeled off and reeled on said reel.

10. A unit as defined in claim 9 including a peripheral rib on the exterior of said dust shield with said peripheral opening in said peripheral rib and substantially tangent to said reel.

* * * * *